US005960238A

United States Patent [19]

Ohgami

[11] Patent Number: 5,960,238

[45] Date of Patent: Sep. 28, 1999

[54] METHOD OF SUPPLYING TONER FOR PROCESS CARTRIDGE AND PROCESS CARTRIDGE FOR IMAGE FORMING APPARATUS

[75] Inventor: Hiroshi Ohgami, Niigata, Japan

[73] Assignee: NEC Corporation, Tokyo, Japan

[21] Appl. No.: 09/062,747

[22] Filed: Apr. 20, 1998

[30] Foreign Application Priority Data

Apr. 25, 1997 [JP] Japan ..... 9-109829

[51] Int. Cl.[6] ..... G03G 15/08

[52] U.S. Cl. ..... 399/258; 141/330; 222/81; 222/DIG. 1; 399/262

[58] Field of Search ..... 399/258, 262, 399/263; 222/DIG. 1, 81, 83; 141/329, 330

[56] References Cited

U.S. PATENT DOCUMENTS 5,079,591 1/1992 Tomita et al. ..... 399/262

5,392,963 2/1995 Kelly et al. ..... 399/262

5,594,535 1/1997 Beaufort et al. ..... 399/262

*Primary Examiner*—Arthur T. Grimley

*Assistant Examiner*—William A Noē

*Attorney, Agent, or Firm*—Young & Thompson

[57] ABSTRACT

A method of supplying toner for refilling a process cartridge of an image forming apparatus of electrophotographic recording system without contaminating the hands of the operator and the image forming apparatus. A process cartridge for an image forming apparatus in which supply toner is supplied to the toner supply section from the outer section, is provided with a toner supply section for supplying toner to a development unit. The process cartridge is provided with a supply toner container made up of material capable of being cut and for containing supply toner, a supply toner container accommodating section for receiving the supply toner container, an edge body for cutting the container, a male screw member for pushing the container so as to be cut, and an engaging member for blocking the passage of cut chips.

8 Claims, 10 Drawing Sheets

METHOD OF SUPPLYING TONER FOR PROCESS CARTRIDGE AND PROCESS CARTRIDGE FOR IMAGE FORMING APPARATUS

BACKGROUND OF THE INVENTION

The present invention relates to a method of supplying toner for a process cartridge of an image forming apparatus and a process cartridge for an image forming apparatus which is used for the image forming apparatus of an electrophotographic recording system.

DESCRIPTION OF THE PRIOR ART

In a copy machine, a facsimile and so forth, an ink jet printing system, a dot matrix system, a thermal transferring system and so forth are adopted as systems for outputting character or graphic form to medium such as paper and so forth. In particular, an image forming apparatus according to an electrophotographic system is capable of outputting clear images in high speed, thereby, recently it comes into wide use. In this kind of device, a charging means, an image development means, a cleaning means, and an electrophotographic photosensitive drum are unified to be a cartridge. It causes the cartridge to mount detachably on the image forming apparatus body. The cartridge is designated as a process cartridge. Recently, the process cartridge comes into wide use.

The conventional image forming apparatus has a construction to incorporate the process cartridge within a device body. When toner is supplied, a toner cartridge is loaded to the process cartridge from an outer side. The toner cartridge contains toner in a container. The toner cartridge is loaded to the process cartridge while opening its opening section so as to be supplied toner into the process cartridge. Consequently, in this construction, when it causes the opening section of the toner cartridge to open in order to supply toner, toner flies in all directions, with the result that there is problem that toner contaminates hands of the operator or the image forming apparatus.

Recently, a process cartridge in which it causes a space for storing toner to provide to be unified to a development unit of the process cartridge have been adopted. There have been made practicable that the operator causes supply toner to be implemented easily by exchanging process cartridge by himself without contaminating hands and so forth of the operator and an image forming apparatus.

The conventional example is explained referring to the drawings. FIG. 1 is a view showing a conventional image forming apparatus of an electrophotographic recording system. FIG. 2 is a view showing a process cartridge being in use for an image forming apparatus of the electrophotographic recording system.

In FIGS. 1, and 2, in the process cartridge 69 which is integrated into the image forming apparatus 68, a Scorotron 62 as a charging unit uniformly charges on the surface of photosensitive drum with minus-charging of electrostatic charge. Subsequently, it causes a latent image to form while erasing parts of the charged area of the photosensitive drum by laser light B. The latent image is developed by the development unit 64 due to toner 72*a* which is minus-charged of electrostatic charge. Then, a toner image 72*b* is transferred by a transfer roller 65 to a paper 69*a*. The paper 69*a* is to be fixed while passing fuser 67. On the other hand, remaining toner 72*e* remained on the photosensitive drum 61 is moved by revolution of the photosensitive drum 61 toward a cleaning unit 66, thus sweeping away by a cleaning blade 66*a*.

In the process of the development, the toner 64*e* of the toner supply body section 64*f* is supplied to a supply roller 64*b* coinciding with churning by a mixer 64*a*. Further, the toner on the supply roller 64*b* is supplied to a development roller 64*c* as a toner holding body, before an excessive toner is swept away by the toner blade 64*d*. At this time, toner 72*a* slipped through the toner blade 64*d* is charged with a proper amount of charging quantity. The toner 72*a* with prescribed charging quantity is moved to development space touching the photosensitive drum 61 together with revolution of the development roller 64*c*. A development field caused by development bias Vb (not illustrated) which is applied to the development roller 64*c* and an electric potential in the latent image on the photosensitive drum 61 is generated within the development space. Concretely, the portion on the photosensitive drum 61 to which the laser light B is irradiated causes minus-electric charge to be erased so that an absolute quantity of the electric potential becomes small. The development field originates to the portion, with the result that the toner 72*a* adheres to on the surface of the photosensitive drum 61 due to the electric field.

In the conventional example, since the toner supply body section accommodating toner 64*e* is sealed, toner supply from the outer section can not be implemented. Consequently, when the toner 64*e* is exhausted by consumption, since it is incapable of supplying toner unless it causes the toner supply body section 64*f* to decompose, the life of the process cartridge 69 is terminated.

As described above, in cases where supply of the toner is incapable of implementing from the outside portion to the process cartridge, if the toner is exhausted by consumption, the life of the process cartridge is terminated. With the result that, another members come to nothing. Cost of consumption articles run up to a large sum. There is a problem that the image forming apparatus of the conventional type becomes a commodity with high running cost. To the contrary, when required toner to the life is filled from the first, there is the problem that the process cartridge itself comes to be large-size, thus it is incapable of planning miniaturization of the image forming apparatus.

SUMMARY OF THE INVENTION

In view of the foregoing, it is an object of the present invention for resolving the above-mentioned problems to provide a method of supplying toner for a process cartridge of the image forming apparatus which does not contaminate the hands of the operator and the image forming apparatus.

It is another object of the present invention to provide a process cartridge for the image forming apparatus which is capable of preventing contamination of the device caused by supply toner, whose running cost is low, and which is capable of planning miniaturization of the image forming apparatus.

In accordance with one aspect of the present invention, for achieving the above-mentioned objects, there is provided a method of supplying toner for a process cartridge detachable to a body of an image forming apparatus of electrophotographic recording system comprising the steps of containing toner into container which is capable of being cut, inserting the container incorporating the toner into the process cartridge, and supplying the toner from an inside of the container to an inside of the process cartridge while cutting the container.

In accordance with another aspect of the present invention, there is provided a process cartridge for an image forming apparatus of an electrophotographic recording system in which it is capable of supplying toner to a toner supply section thereof from an outer section, having a process cartridge body being composed of a development unit and a toner supply section for supplying toner to the development unit, in the process cartridge for the image forming apparatus, a supply toner container consisting of a container made up of material which is capable of being cut, and a supply toner being contained therein, the toner supply section consisting of a supply toner container accommodating section for receiving the supply toner container therein and a cutting mechanism for cutting the container of the supply toner container which is accommodated in the supply toner container accommodating section.

Preferably, in the above another aspect of the present invention, there is provided a process cartridge for an image forming apparatus, wherein the toner supply section comprises the supply toner container accommodating section, and a toner supply body section which opens continuously to the supply toner container accommodating section for storing toner supplied from the supply toner container accommodating section and for supplying toner to an inside of the development unit, the supply toner container accommodating section comprises a supply toner container arranging section in which female screw section is provided from an opening side toward the toner supply body section at internal surface thereof, and the supply toner container is allocated therein, an edge body provided at a side of the toner supply body section and a male screw member which is screwed in the female screw section for pushing the supply toner container allocated in the supply toner container arranging section to the edge body such that the container is cut.

Preferably, in the above another aspect of the present invention, there is provided a process cartridge for an image forming apparatus, wherein an engaging member for avoiding a passage of broken chips at the side of the toner supply body section from the edge body is allocated in the toner supply section, and it provides space between the edge body and the toner supply body to be a storing section.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

A preferred embodiment of the present invention will now be described in detail referring to accompanying drawings.

Figure 1:
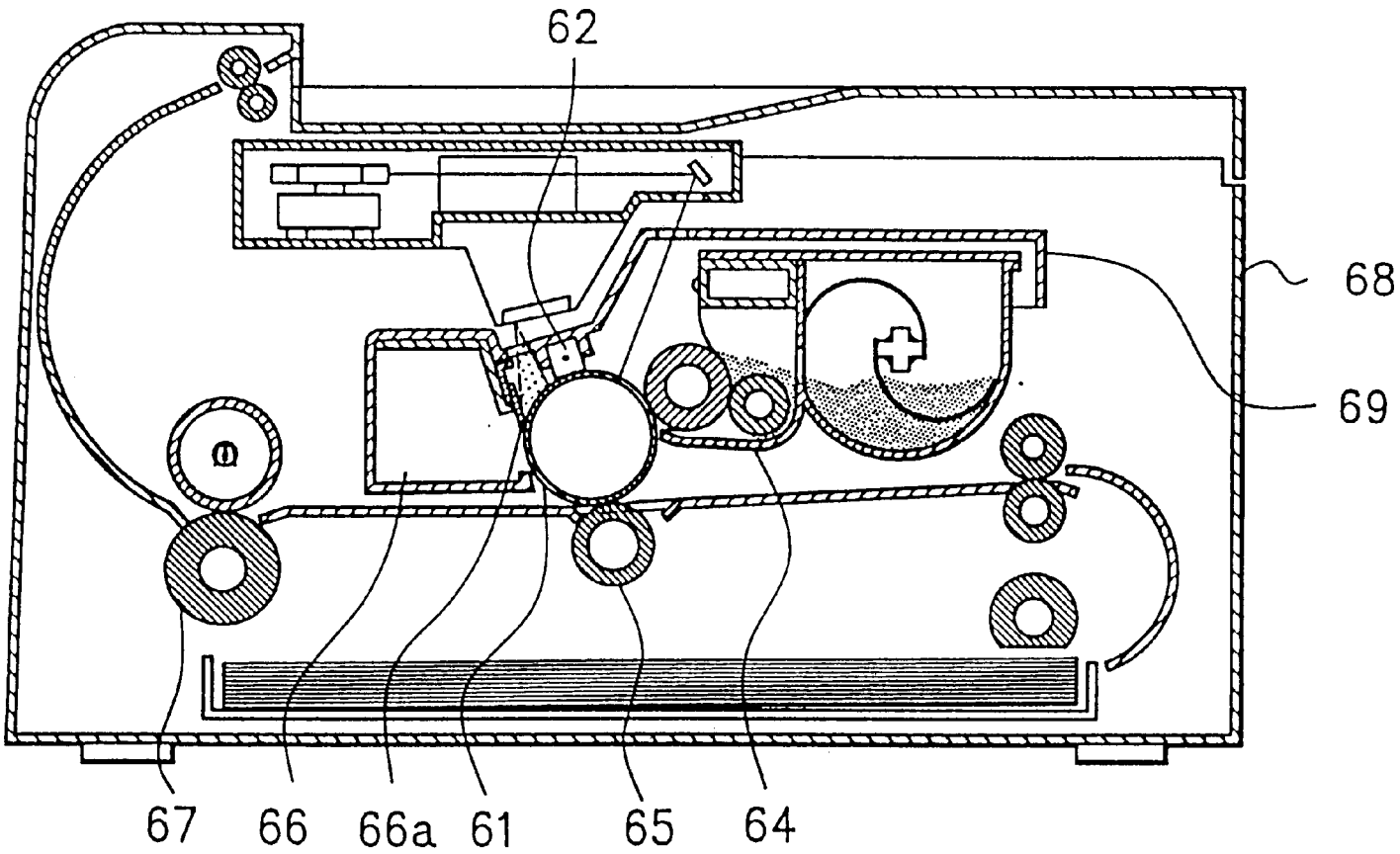
FIG. 1 Prior Art
FIG. 1 is a sectional view showing an image forming apparatus of electrophotographic recording system provided with a conventional process cartridge.
Figure 2:
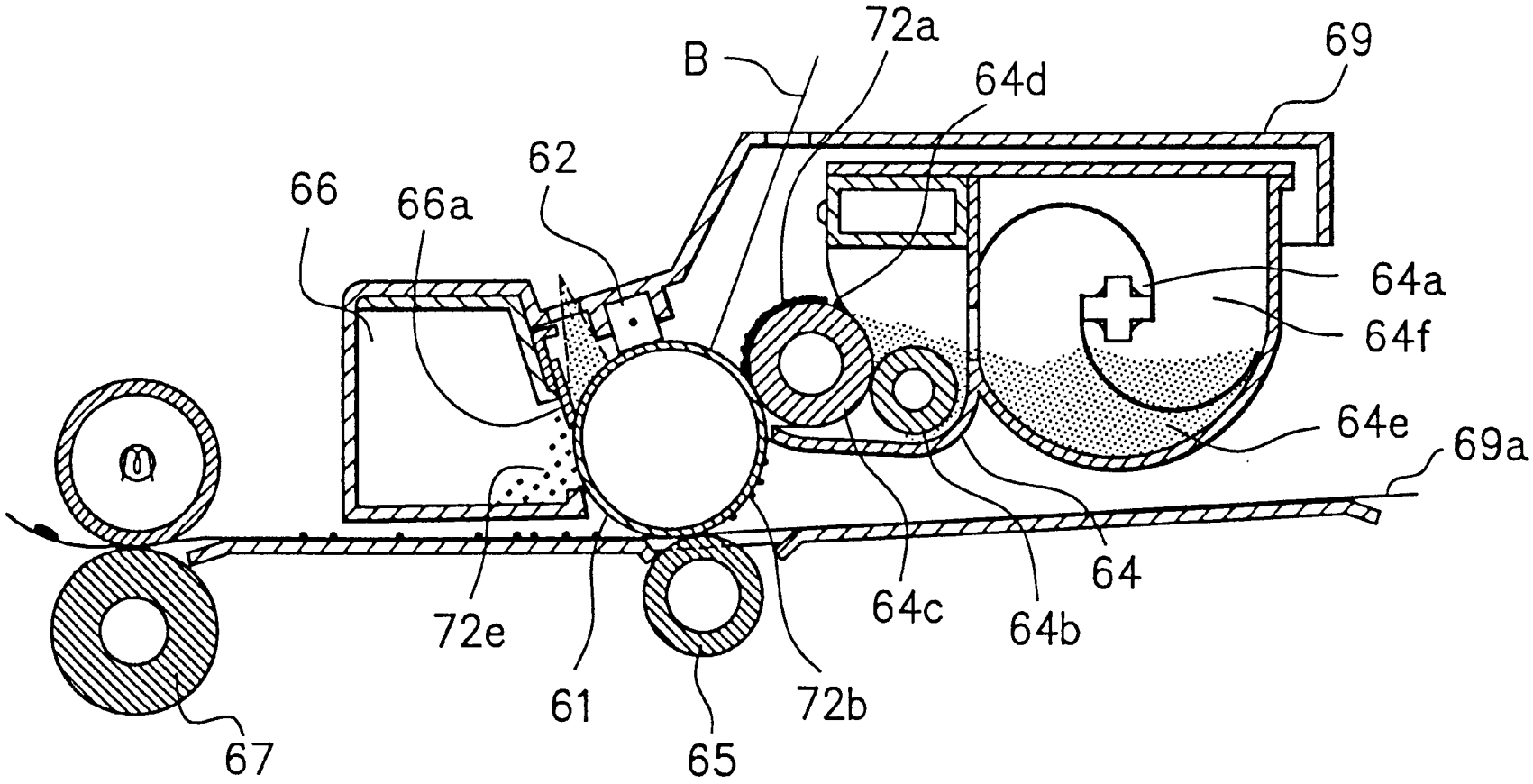
FIG. 2 Prior Art
FIG. 2 is a sectional view showing the conventional process cartridge.
Figure 3:
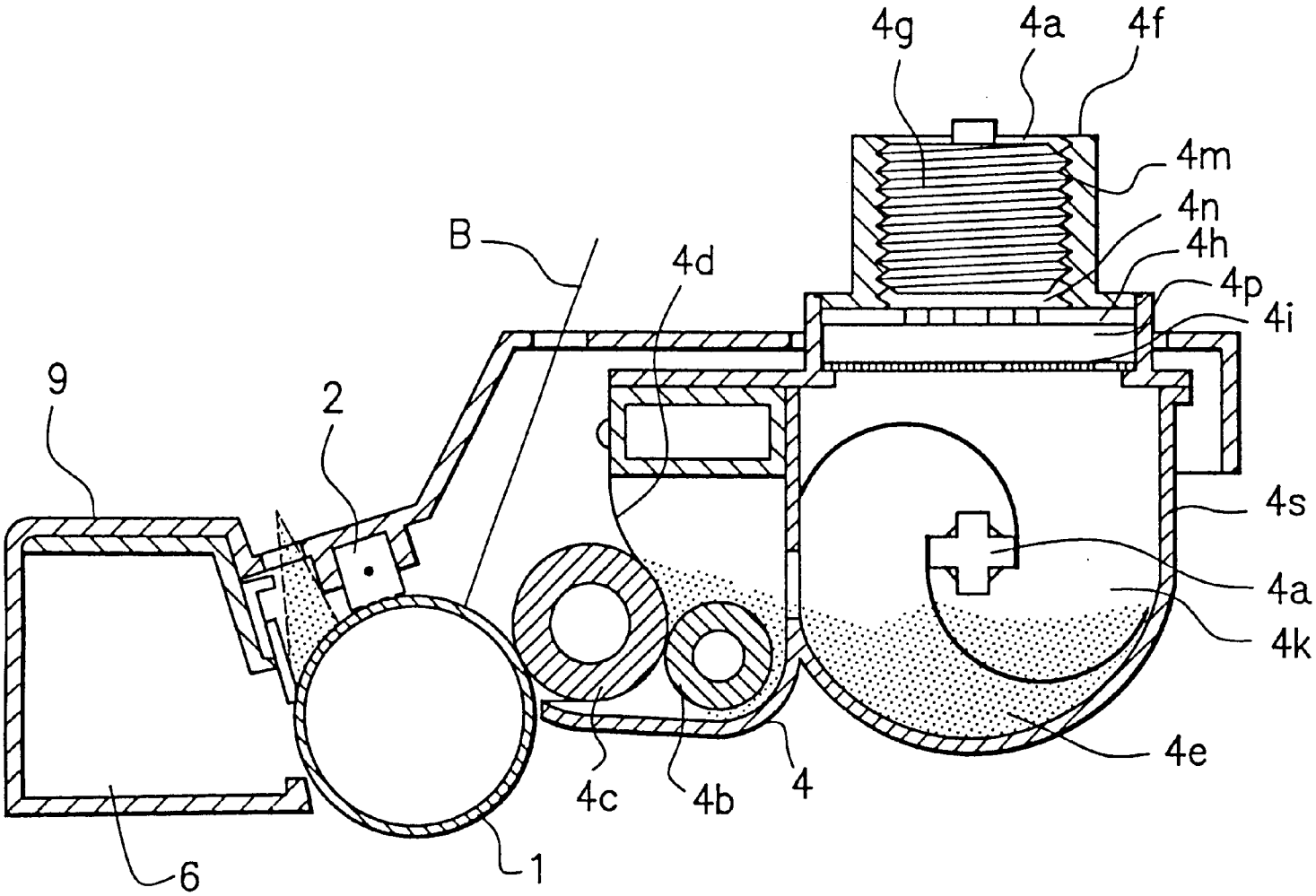
FIG. 3 is a sectional view showing a process cartridge according to a first embodiment of the present invention.
Figure 4:
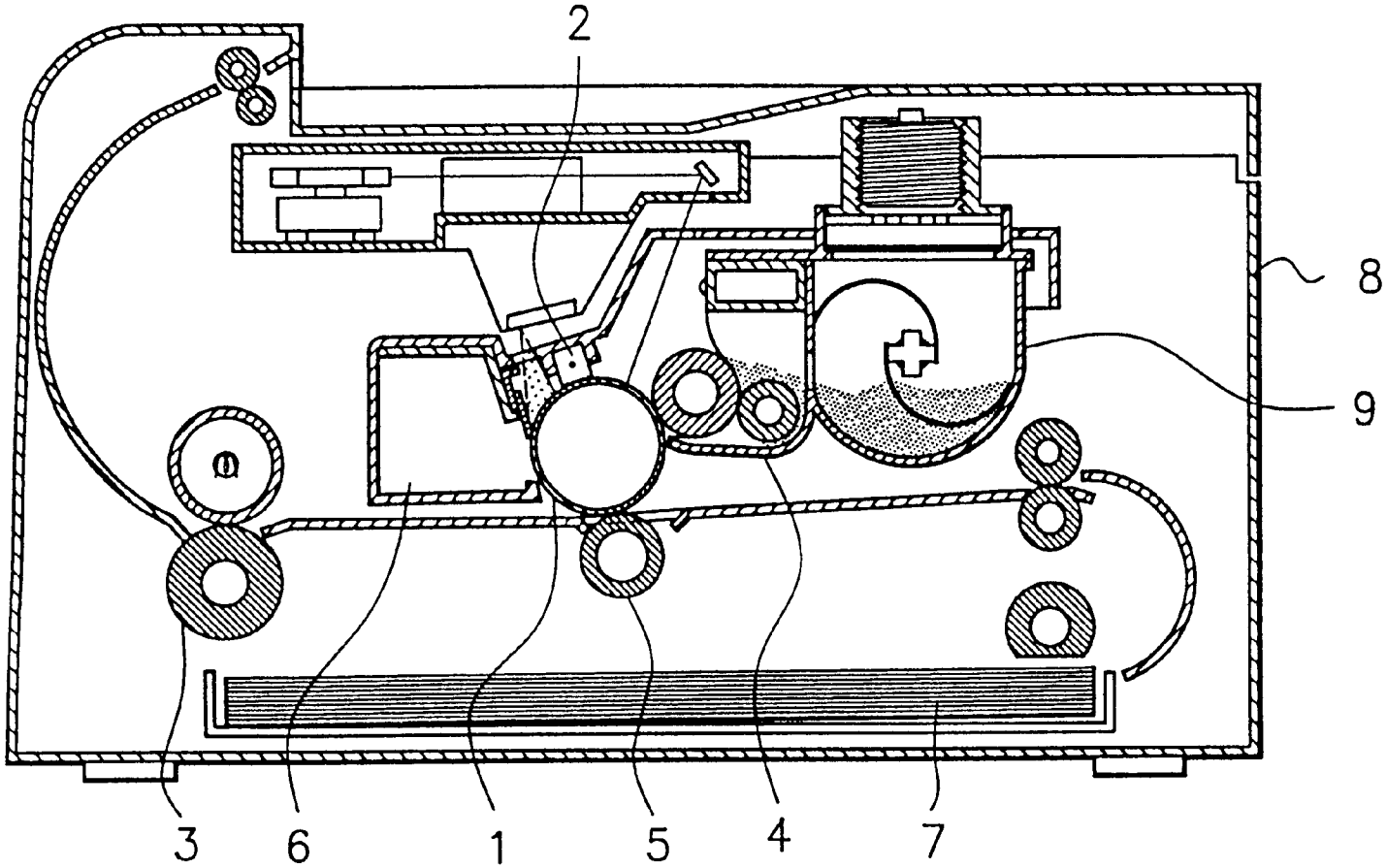
FIG. 4 is a sectional view showing an image forming apparatus of electrophotographic recording system provided with the process cartridge of FIG. 3.
Figure 7B:
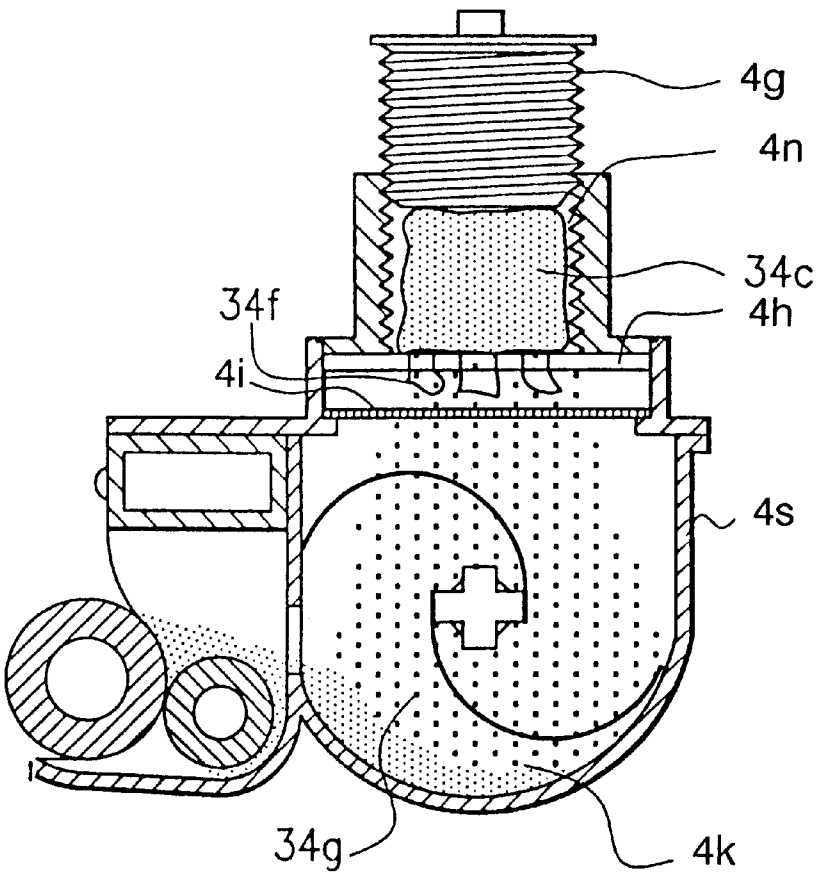
FIGS. 7A, 7B are sectional views showing process cartridge explaining supplying method of toner to the process cartridge of the first embodiment of the invention.
Figure 7A:
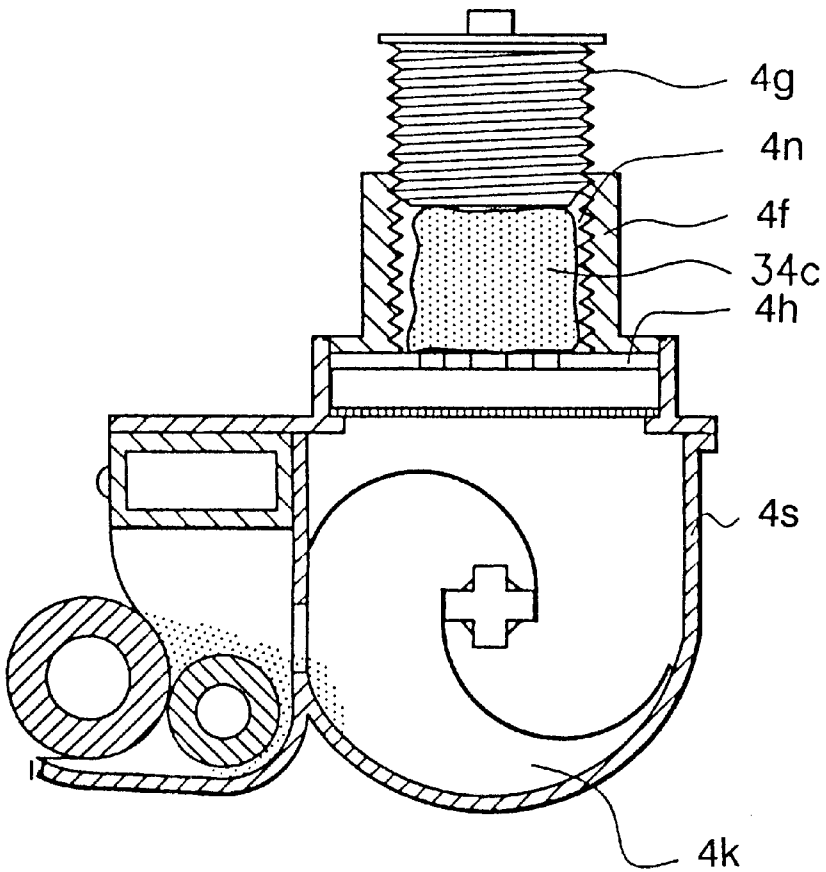

FIGS. 3, 4, and 7A are views for explaining the first embodiment of the present invention. FIG. 3 shows the process cartridge being in use for the image forming apparatus. FIG. 4 shows the image forming apparatus. FIG. 7A shows an enlarged part of the process cartridge 9 of FIG. 3.

In FIG. 4, respective process means which are a charging means, an exposure means, an image development means, a transfer means and a cleaning means, are arranged around a photosensitive drum 1 of the process cartridge 9 mounted on the image forming apparatus 8. A Scorotron 2 is in use for charging, thus voltage Vs for charging is applied. Surface electric charge disappears by selective irradiation of laser B after charging, thus a latent image is formed. The latent image is developed by development unit 4 to toner image. The toner image is transferred on a paper (paper 7 is supplied to be carried) which is storage medium by a transferring roller 5 to which transferring bias Vt is applied. The transferred toner image is fixed by a fuser 3, thus terminating the printing. At this time, toner which is remained on the photosensitive drum 1 and others are removed by the cleaning unit 6.

At the process of development, toner 4*e* of toner supply body section 4*k* is agitated by mixer 4*a,* simultaneously being supplied to a supply roller 4*b* in a toner supply section 4*s* of the process cartridge 9 shown in FIG. 3. Accompanying with this, toner is supplied on the development roller 4*c* which is toner maintaining body from the toner supply roller 4*b*. An excessive toner is swept away by the toner blade 4*d*. Mono component non-magnetic toner is in use for toner 4*e* of the toner supply body section 4*k*. The quality of the material and the shape of the toner blade 4*d,* and the pressing force of the toner blade 4*d* are determined such that approximately one layer of thin layer of the toner on the developing roller 4*c* is formed and toner charging quantity has appropriate vale.

A toner supply section 4*s* comprises a supply toner container accommodating section 4*f,* and toner supplying body section 4*k* opens continuously to the supply toner container accommodating section 4*f* which section 4*k* stores toner being supplied from the supply toner container accommodating section 4*f* and supplies toner for inside of the development unit 4. The supply toner container accommodating section 4*f* comprises a supply toner container allocating section 4*n,* an edge body 4*h,* and a male screw member 4*g*. The supply toner container allocating section 4*n* in which female screw section 4*m* is formed from the side of the opening 4*q* to the toner supply body section 4*k,* and a supply toner container (described below) is allocated therein is provided. The edge body 4*h* is a cutting mechanism arranged at the side of the toner supply body section 4*k*. The male screw member 4*g* is screwed in the female screw section 4*m* to push against the supply toner container toward the edge body 4*h* which container is allocated in the supply toner container allocating section 4*n,* such that the supply toner container is cut by the edge body 4*h*. Further, when the male screw member 4*g* is screwed in the female screw section 4*m* perfectly, base portion of the male screw member 4*g* does not come into contact with the edge body 4*h*.

In the toner supply section 4*s,* an engaging member 4*i* is allocated at the side of the toner supply body section 4*k* of the edge body 4*h* to avoid passage of chips broken from the container. Space between the edge body 4*h* and the toner supply body section 4*k* is a storing section 4*p* of the chips of container.

In FIG. 7A, supply toner is contained in a container which is made up of material capable of being cut by the edge body 4*h,* represented as supply toner container 34C.

With reference to the edge body 4*h* shown in FIG. 3, whose material is not provided particularly. A metallic edge is suitable in a specific characteristic. A resinous edge or ceramic edge is also capable of being used. A sharp edge is suitable. The edge body 4*h* has matrix shaped configuration in this embodiment. However in the edge body 4*h,* alternative edges are suitable. The crossing angle of the edges are not necessarily 90°, it is capable of selecting alternative angles. Appropriate aperture area is necessary for passing the chips broken from the container of supply toner container.

For instance, a net is in use for the engaging member 4*i*. The mesh of the net which is of 10 μm to several mm is capable of being used. When the mesh of the net is too small, the toner is blocked easily, accordingly degree of 2 to 3 mm of mesh of the net is appropriate. The quality of the material of the engaging member 4*i* is not provided particularly.

A supply toner container 34*c* shown in FIG. 7A which contains supply toner is capable of being cut. The supply toner container 34*c* is suitable of any of a flexible bag, a flexible case, a capsule or the like. Further the quality of the material of the supply toner container 34*c* is suitable of any of resin material, resin sheet, paper sheet, metal foil sheet, or cloth or ceramics or the like.

Next, supply method of the toner to the process cartridge in the above described image forming apparatus.

As shown in FIG. 7A, when toner of the toner supply body section 4*k* of the toner supply section 4*s* is exhausted by consumption, it causes the male screw member 4*g* to be removed. A new supply toner container 34*c* is inserted into the supply toner container allocating section 4*n* of the supply toner container accommodating section 4*f*. Then the male screw member 4*g* is screwed in the female screw section. At this time, the supply toner container 34*c* comes into contact with the edge body 4*h*. However, the supply toner container 34*c* is not cut because the supply toner container 34*c* is not pushed by the male screw member 4*g*.

As shown in FIG. 7B, the male screw member 4*g* may be screwed toward the toner supply body section 4*k,* the supply toner container 34*c* is pushed to the edge body 4*h*. The supply toner container 34*c* is cut by the edge body 4*h*. The supply toner is taken out from the inside of the container. The supply toner 34*g* is supplied to the toner supply body section 4*k* while passing easily through the mesh of the engaging member 4*i*. The chips broken from the container 34*f* are not passed through the engaging member 4*i* because the size of the broken chips of container 34*f* is larger than the mesh of the engaging member 4*i*. The broken chips of container 34*f* do not penetrate the toner supply body section 4*k*.

Figure 8B:
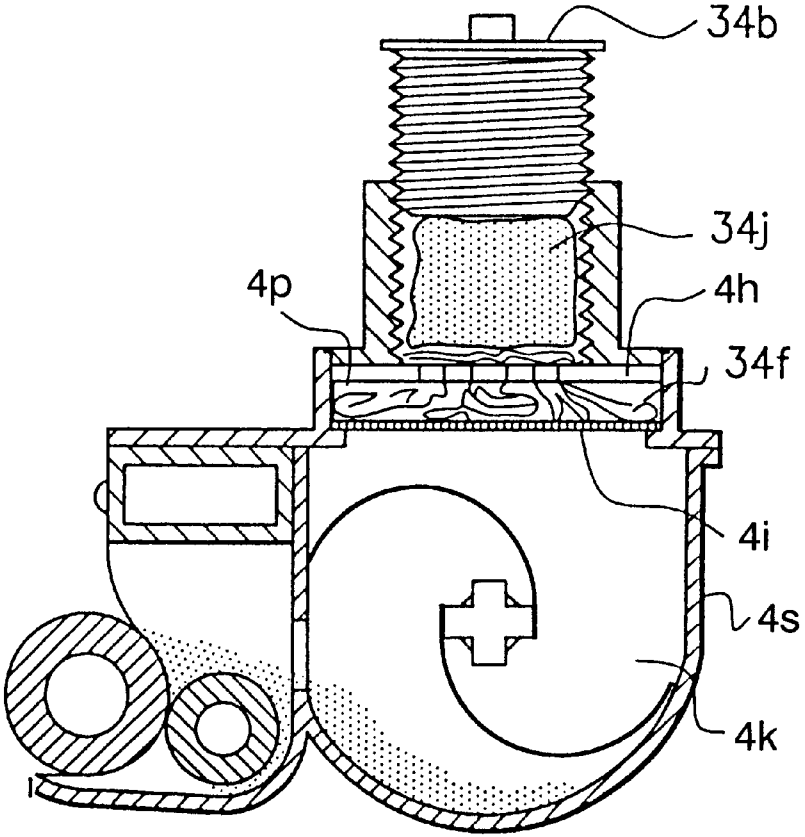
FIGS. 8A, 8B are sectional views showing process cartridge explaining supplying method of toner to the process cartridge according to the first embodiment of the invention.
Figure 8A:
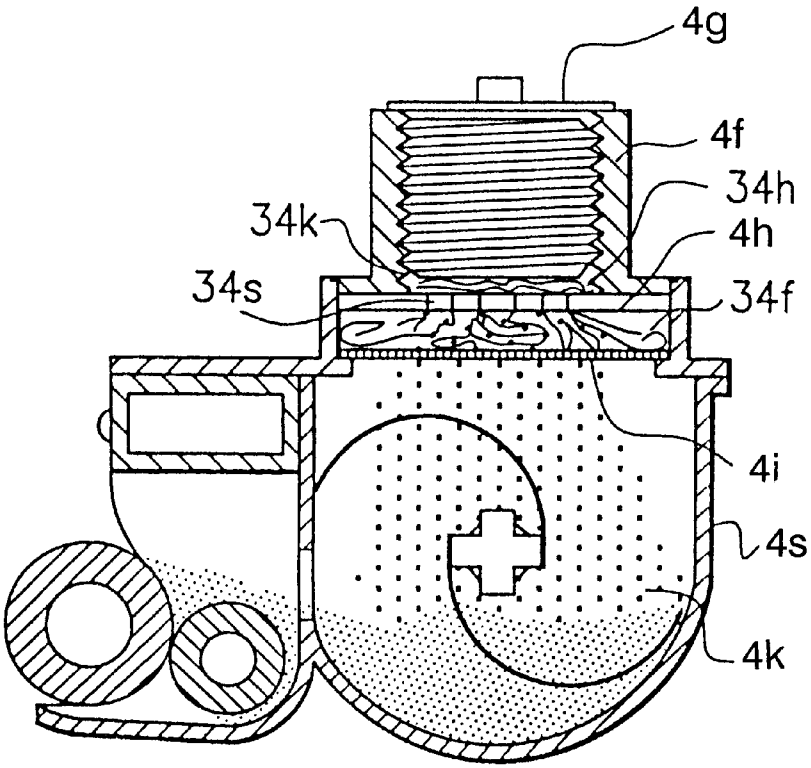

As shown in FIG. 8A, even if it causes the male screw member 4*g* to screw in the supply toner container accommodating section 4*f* perfectly, a part of the chips of container of the supply toner container remains on the edge body 4*h,* because space 34*k* exists in between the male screw member 4*g* and the edge body 4*h*. At this state, the process cartridge is used again. Here, if the male screw member 4*g* comes into contact with the edge body 4*h* perfectly, the part of the chips of container is cut completely by the edge body 4*h,* thus being pushed out under the edge body 4*h* perfectly. The toner 34*s* which is attached to the edge body 4*h* is attached to the base of the male screw member 4*g* contacted to the edge body 4*h*. At the next time of supply toner, when the male screw member 4*g* is taken out, the toner flies in all directions thus contaminating the device and hands of the operator.

As shown in FIG. 8B, when the toner of the toner supply body section 4*k* is exhausted by consumption again, a new supply toner container 34*j* is inserted. Subsequently the male screw member 4*g* is screwed therein. Refuse chips 34*f* broken from the previous container are pushed out at under portion of the edge body 4*h*. A new supply toner container 34*j* is cut by the edge body 4*h,* before the supply toner is supplied to the toner supply body section 4*k*. Additionaly refuse chips 34*f* are cut into small pieces. However, the refuses are not passed through the engaging member 4*i*. The refuses are accumulated at storing section 4*p* for the chips of container 34*f* in between the engaging member 4*i* and the edge body 4*h*. Since new supply toner passes through gap of chips of container 34*f* of the container easily, the chips of container 34*f* does not influence the supply of the toner. Further, since the quality of the material of the chips of container of the toner container is of flexible bag, or flexible case or capsule, the broken chips of container 34*f* of the toner container is collapsed by another chips of container of the container which enters one after another successively. The collapsed chips of container are accumulated in the storing section 4*p*.

As described above, in the process cartridge for the image forming apparatus, the supply toner does not fly outside the section of the process cartridge. Further the operator inserts the supply toner container into the process cartridge, subsequently, it causes the male screw member to screw, thus implementing toner supply.

Consequently, according to the above described process cartridge for the image forming apparatus, the supply toner is not scattered from the outer section of the process cartridge. It is capable of implementing toner supply without contaminating the hands of the operator and the image forming apparatus. Further, since the operator can supply toner only screwing the male screw member, while inserting the supply toner container into the process cartridge, it is capable of implementing toner supply with the simple operation.

Figure 5:
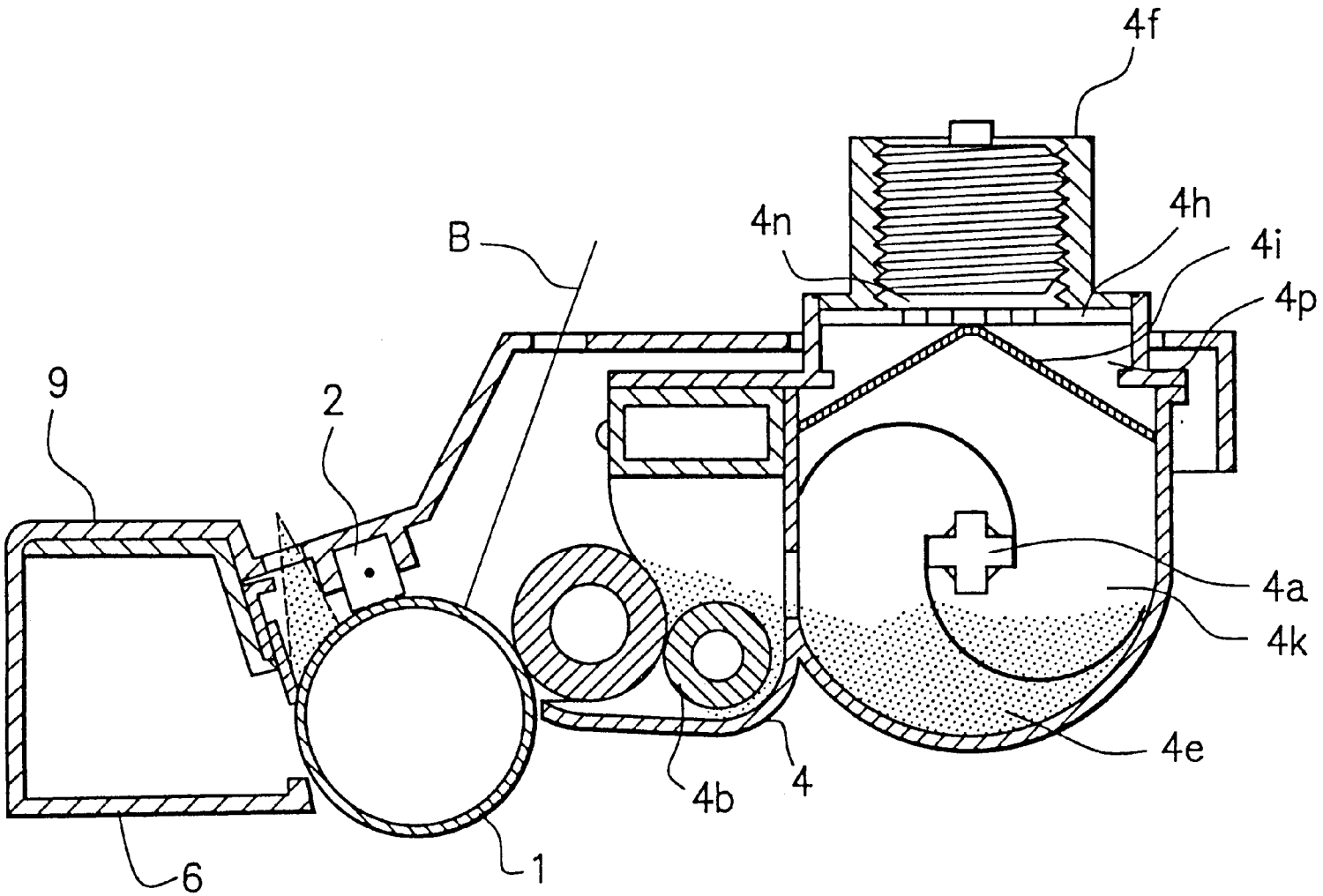
FIG. 5 is a sectional view showing a process cartridge according to a second embodiment of the present invention.

Next, a second embodiment of the invention will be described referring to drawing. FIG. 5 is a view showing a process cartridge for the image forming apparatus explaining the second embodiment of the invention.

In this second embodiment, only the different points from the first embodiment are explained.

As shown in FIG. 5, in this process cartridge 9, an engaging member 4*i* is bent in such a way that bent portion is directed to the side of the supply toner container accommodating section 4*f*.

The revolution of mixer 4*a* comes into smooth contact with the inside of the toner supply body section 4*k*. The capacity of the storing section 4*p* of the chips of container of the supply toner container in between the edge body 4*h* and the toner supply body section 4*k* is enlarged. Consequently, it is capable of supplying the toner 4*e* efficiently to the development unit 4 due to the revolution of the mixer 4*a*. The thusly enlarged storing section 4*p* accumulates a larger quantity of refuse chips, thereby it is capable of more toner refills before the storage section 4*p* is filled.

Next, a third embodiment of the present invention will be described referring to the drawings. FIGS. 6A, 6B, 9A, 9B, 10A, and 10B are views showing a process cartridge for the image forming apparatus of a third embodiment.

Figure 6B:
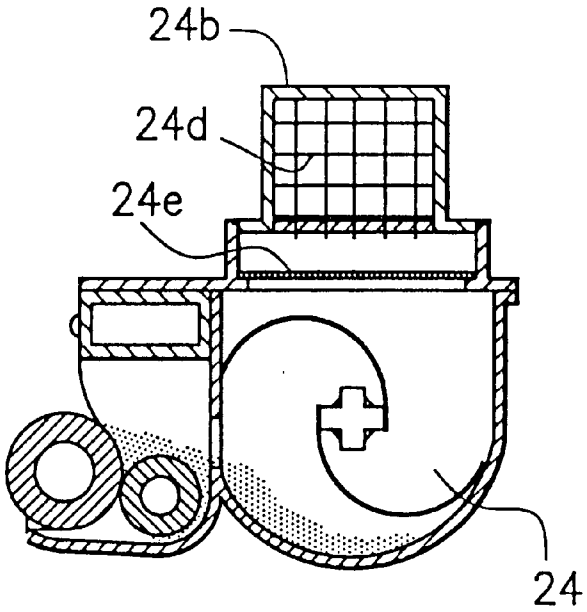
FIG. 6B is a sectional view along A—A line of FIG. 6A.
Figure 6A:
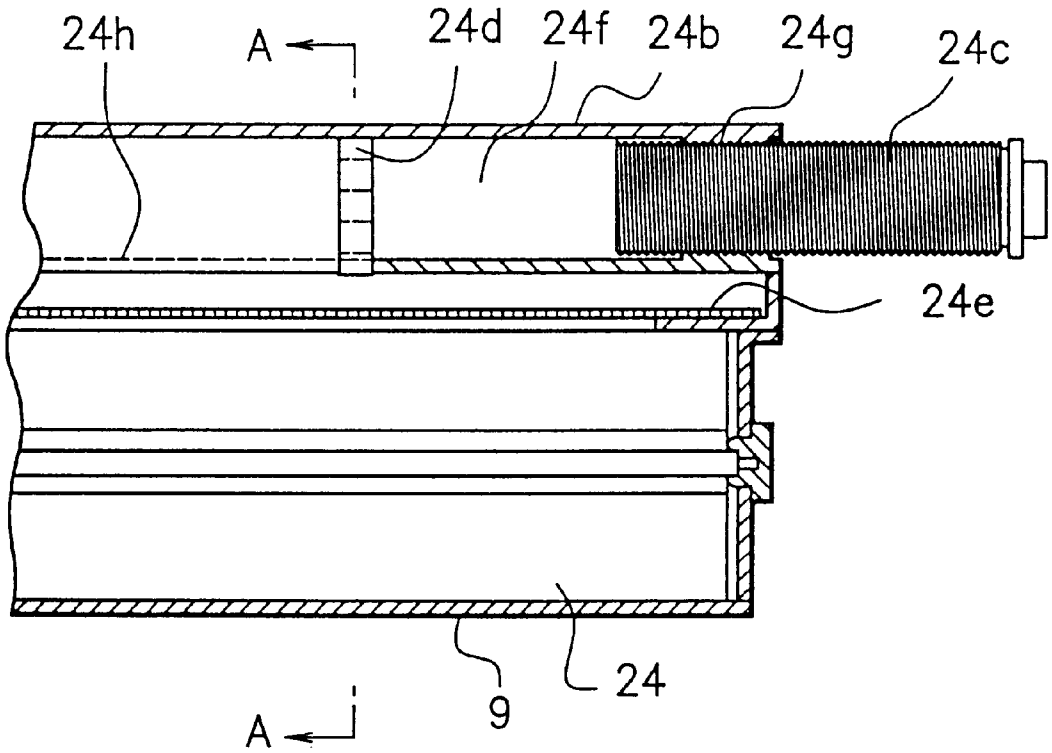
FIG. 6A is a sectional view showing a principal portion of the process cartridge according to third embodiment of the invention.

In FIGS. 6A, and 6B, in the process cartridge 9, there are provided a supply toner container allocating section 24*f* for allocating the supply toner container to the inside of the supply toner container accommodating section 24*b*, a female screw section 24*g* which is provided with the side of the supply toner container accommodating section 24*b* from the opening to the edge body 24*d*, and a male screw member 24*c* which is screwed in the female screw section 24*g*. An edge body 24*d* is arranged in the toner container accommodating section 24*b*. In the drawing, left side of the edge body 24*d*, there is the opening 24*h* which continuously opens to the toner supply body section 24, and an engaging member 24*e* is allocated in between the opening 24*h* and the toner supply body section 24.

Figure 9B:
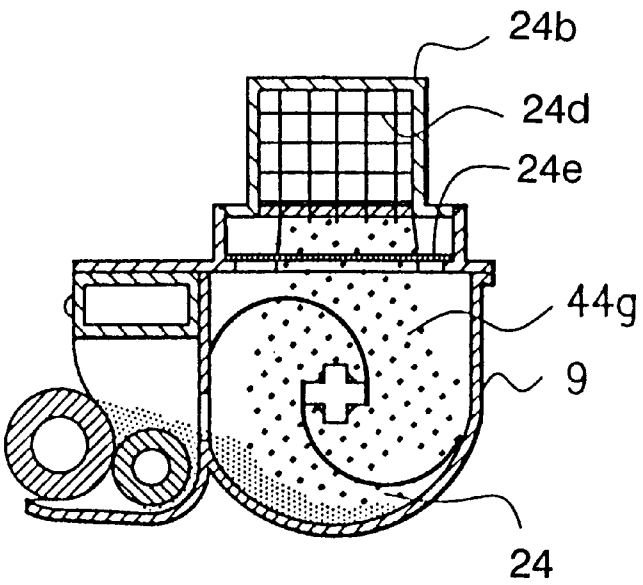
FIG. 9B is a sectional view along A—A line of FIG. 9A.
Figure 9A:
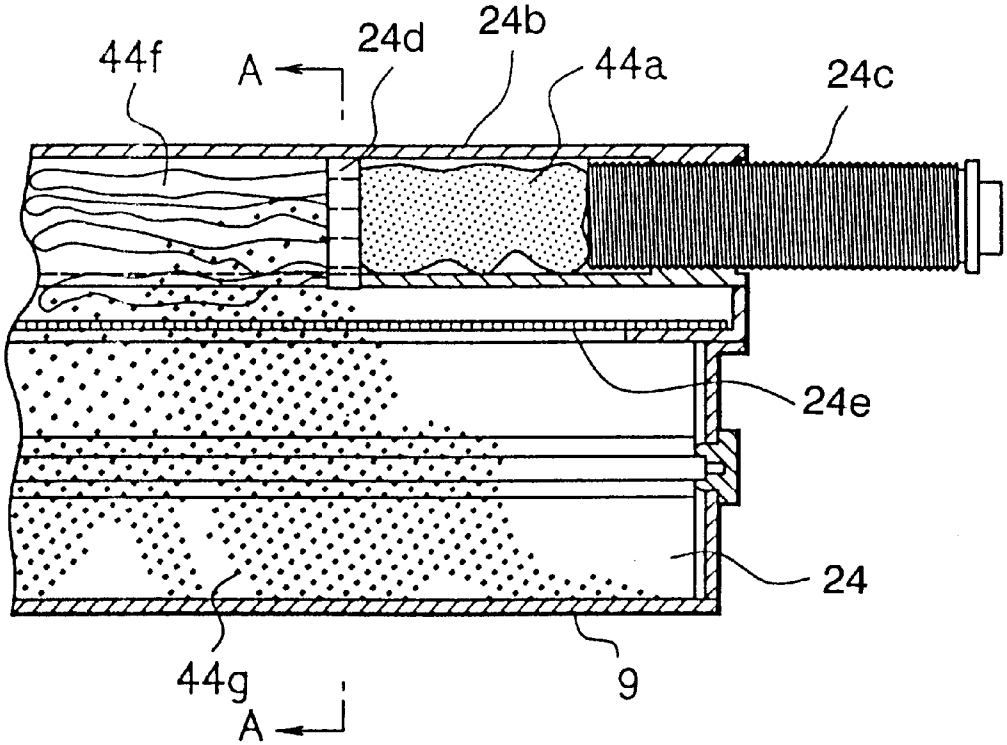
FIG. 9A is a sectional view showing a principal portion of the process cartridge according to third embodiment of the invention.

As shown in FIGS. 9A, and 9B, a supply toner container 44*a* is inserted into the supply toner container accommodating section 24*b* of the process cartridge. At this case, as the male screw member 24*c* is screwed therein, the supply toner container 44*a* is pushed to the edge body 24*d*, subsequently, the supply toner container is cut to release the toner 44*g*. The supply toner 44*g* is supplied to the toner supply body section 24 passing through the engaging member 24*e*. The chips of container 44*f* of the supply toner container is incapable of passing the engaging member 24*e*, thus not penetrating the toner supply body section 24.

Figure 10B:
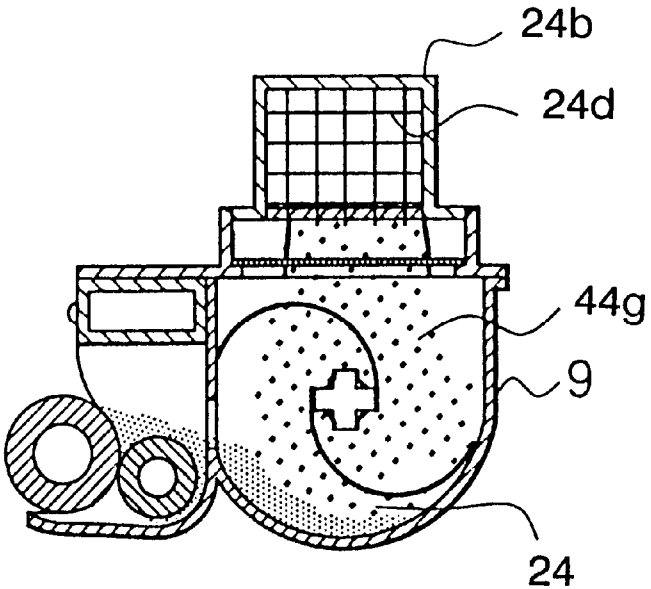
FIG. 10B is a sectional view along A—A line of FIG. 10A.
Figure 10A:
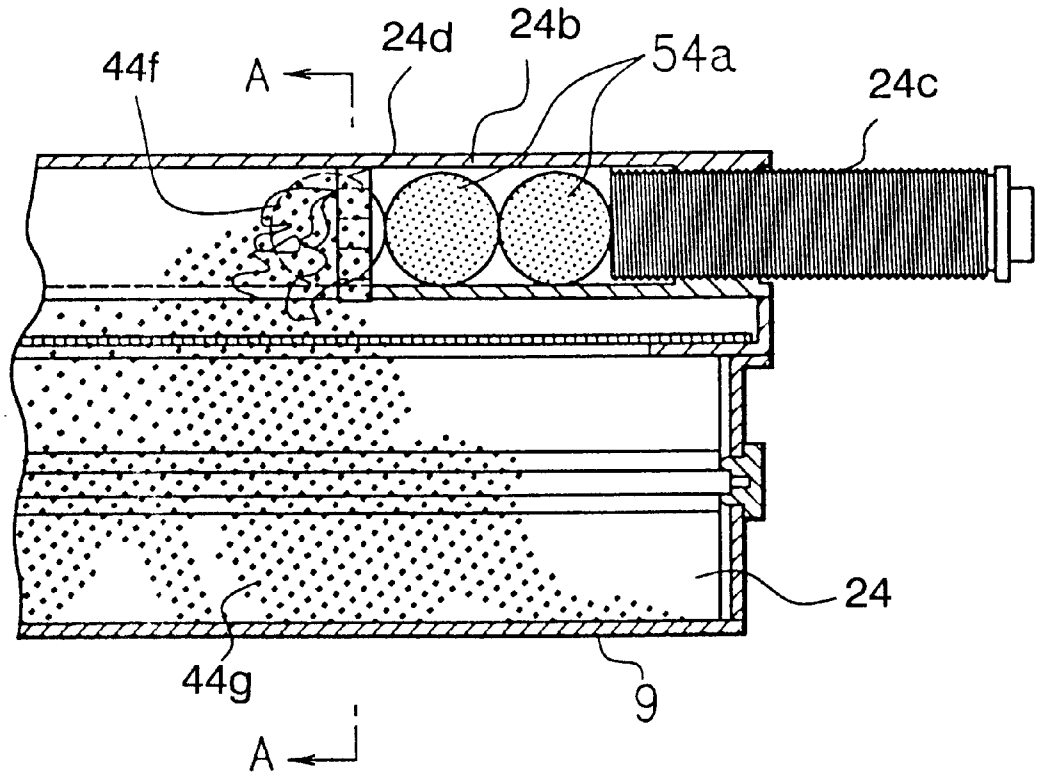
FIG. 10A is a sectional view showing the process cartridge according to third embodiment of the invention.

In FIGS. 10A, and 10B, subdivided supply toner containers 54*a* are inserted into the supply toner container accommodating section 24*b* with one or several pieces.

In the case of above described process cartridge, capacity of the supply toner container accommodating section 24*f* of FIGS. 6A, and 6B is capable of enlarging than that of the supply toner container accommodating section 4*n* of the process cartridge of FIGS. 3 and 5 of the first and second embodiments.

Consequently, since it is capable of inserting larger supply toner container or subdivided supply toner containers into the process cartridge, it is capable of supplying a lot of toners to the process cartridge by only one toner supply.

Besides, a scope of the technology of the present invention is not restricted by the above described embodiment. It is capable of adding various changes within the scope which does not depart the gist of the invention. For instance, in the above-described embodiments, it causes the supply toner container to push by a rod to the edge body. There is explained the invention as an example of mono component non-magnetic toner, it does not depend upon kinds of toner. It is capable of being applied to two components toner, or magnetic toner or the like. In the embodiment, the example of the image forming apparatus is explained. However the present invention is capable of being applied to a printer of electrophotographic recording system, a copying machine, facsimile machine or the like.

As described in detail, according to the supply method of toner for the process cartridge of the present invention, it is capable of supplying toner to the process cartridge without contaminating hands of the operator and the image forming apparatus by supply toner.

Further, according to the process cartridge of the present invention, it is capable of being supplied toner to the process cartridge without contaminating hands of the operator and the image forming apparatus. It is capable of providing process cartridge for the image forming apparatus to plan to miniaturize the image forming apparatus with low running cost.

While preferred embodiments of the invention have been described using specific terms, such description is for illustrative purpose only, and it is to be understood that changes and variations may be made without departing from the spirit or scope of the following claims.

What is claimed is:

1. A method of refilling a process cartridge of an electrophotographic imaging apparatus, comprising the steps of:

providing refill toner in a refill container, the refill container being designed and adapted for being cut to release the refill toner;

providing a process cartridge comprising a sealable chamber designed and adapted to house the refill container and to pass the refill toner into an interior of the process cartridge, the sealable chamber further comprising a screening means for preventing chips broken from the refill container from passing into the interior of the process cartridge;

with the sealable chamber being unsealed, inserting the refill container into the sealable chamber of the process cartridge; and sealing the sealable chamber, wherein the action of sealing the sealable chamber cuts the refill container and releases the refill toner from the refill container for passage into the interior of the process cartridge.

2. A process cartridge for an image forming apparatus of an electrophotographic recording system capable of supplying toner to a toner supply section thereof from an outer section, comprising:

a development unit;

a toner supply section for supplying toner to said development unit;

a supply toner container comprising a container of material designed and adapted for being cut;

a supply toner being contained within said container;

said toner supply section comprising: a supply toner container accommodating section for receiving said supply toner container and a toner supply body section which opens continuously to said supply toner container accommodating section for storing toner supplied from said supply toner container accommodating section and for supplying toner to an inside of said development unit;

said supply toner container accommodating section comprising:

a supply toner container allocating section comprising a female screw section with an opening side toward said toner supply body section at an internal surface thereof, said supply toner container being allocated therein;

an edge body provided at a side of said toner supply body section; and a male screw member which is screwed in said female screw section for pushing said supply toner container allocated in said supply toner container arranging section against said edge body such that said supply toner container is cut.

3. The process cartridge of claim 2, further comprising an engaging member for preventing a passage of chips broken from said container by said edge body, said engaging member being positioned to provide a space between said edge body and said toner supply body to serve as a storing section.

4. A refillable process cartridge for an electrophotographic imaging apparatus, comprising:

a refill container, filled with toner, with a surface designed and adapted for being cut to release the refill toner from said refill container;

a process cartridge comprising an interior, a sealable chamber for housing said refill container, and an opening communicating with said chamber and said interior for passing said toner into said interior, said opening comprising a screen designed and constructed to block chips broken from said refill container from passing into said interior;

a sealing means for sealing and unsealing said sealable chamber; and a cutting means located within said chamber designed and adapted to cut said refill container upon said sealing means sealing said sealable chamber and being urged against said refill container.

5. The refillable process cartridge of claim 4, wherein said sealable chamber further comprises a threaded female opening positioned to receive said refill container, and said sealing means further comprises a threaded male screw adapted for engaging said threaded female opening, and upon such engagement for being urged against said refill container.

6. The refillable process cartridge of claim 5, wherein said refill container further comprises an approximately spherical container.

7. The refillable process cartridge of claim 5, wherein said refill container further comprises one of a flexible bag, a flexible case, and a capsule.

8. The refillable process cartridge of claim 4, wherein said opening further comprises a storage compartment designed and adapted for storing chips broken from said refill container.

* * * * *